US005351113A

United States Patent [19]

Pietrowski et al.

[11] Patent Number: 5,351,113

[45] Date of Patent: Sep. 27, 1994

[54] PRE-PRETRANSFER TREATMENT TO INCREASE TRANSFER LATITUDE IN TRI-LEVEL XEROGRAPHY

[75] Inventors: Kenneth W. Pietrowski, Penfield; Larry G. Hogestyn, Ontario; Delmer G. Parker, Rochester, all of N.Y.

[73] Assignee: Xerox Corporation, Stamford, Conn.

[21] Appl. No.: 179,176

[22] Filed: Jan. 10, 1994

[51] Int. Cl.[5] ..... G03G 15/16

[52] U.S. Cl. ..... 355/273; 430/126

[58] Field of Search ..... 355/273, 272, 326, 327, 355/208; 430/33, 126

[56] References Cited

U.S. PATENT DOCUMENTS

| | | | |
|---|---|---|---|
| 3,444,369 | 5/1969 | Malinaric | 250/65 |
| 3,784,300 | 1/1974 | Hudson et al. | 355/3 |
| 4,078,929 | 3/1978 | Gundlach | 96/1.2 |
| 4,205,322 | 5/1980 | Tsuzuki et al. | 346/153 |
| 4,506,971 | 3/1985 | Buell et al. | 355/3 TR |
| 5,038,177 | 8/1991 | Parker et al. | 355/273 |
| 5,119,140 | 6/1992 | Berkes et al. | 355/273 |
| 5,241,358 | 8/1993 | Germain | 355/326 |
| 5,260,752 | 11/1993 | Fuma et al. | 355/273 |

*Primary Examiner*—R. L. Moses

[57] ABSTRACT

Pre pretransfer treatment for multiple toner toner images increases the operating latitude for pretransfer/-transfer. In one embodiment of the invention, a pre pretransfer corona device is used to drive the tribos of two multiple toner images toward each other prior to pretransfer. A single constant current corona discharge device is used in this embodiment. Subsequent pretransfer treatment serves to reduce the delta tribo between the two images thereby providing an operating latitude of 3 micro coul/g.

26 Claims, 4 Drawing Sheets

PRE-PRETRANSFER TREATMENT TO INCREASE TRANSFER LATITUDE IN TRI-LEVEL XEROGRAPHY

BACKGROUND OF THE INVENTION

This invention relates generally to xerographic imaging employing multiple development and or process steps that result in significant variations in tribo charge between the independently developed toner images. More particularly, a method and apparatus is described for more efficiently transferring the toned images from a charge retentive surface to a substrate such as plain paper. Examples of multiple toner xerographic imaging include the multipass, image on image, full color systems and the tri-level, highlight color imaging schemes.

In the multipass, image on image system as many as four toners are sequentially developed either adjacent to or on top of each other before they are simultaneously transferred to the substrate in a single transfer step. As the multiple toner image is constructed on the charge retentive surface such as a photoreceptor, as many as three of the toners are exposed to up to three corona charging events by the photoreceptor charging device. The fourth and or last toner on the other hand is not. Since the corona charging history of the toners varies dramatically it is not surprising to find significant differences in their tribo values prior to transfer.

In tri-level, highlight color imaging, unlike conventional xerography, the image area contains three voltage levels which correspond to two image areas and to a background voltage area. One of the image areas corresponds to non-discharged (i.e. charged) areas of the photoreceptor while the other image areas correspond to discharged areas of the photoreceptor. Similarly to the multipass example, the tribo of the toners developed in these charged and discharged areas are significantly different and in this case of opposite polarity.

The tri-level, highlight color imaging example is used to describe the merits of this invention. The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

When using both DAD and CAD process simultaneously, the photoreceptor is developed with both color and black and color toners having negative and positive charge, respectively. Since the transfer corona device used in tri-level imaging has only one polarity, positive for example, just one of the images, color for example, would transfer to the final substrate. To deal with this situation, a corona discharge device is positioned immediately following the second developer housing, in this case the black developer housing, but preceding the transfer corona device. The function of the pretransfer corona device is to apply a corona of either negative or positive polarity so as to reverse the polarity of one of the two developed images, for example the black image.

While pretransfer corona reverses the sign of one of the two toners, it also adds additional charge to the other toner that is of the same polarity as the pretransfer device. Sometimes this additional charge is enough to cause the charge on that toner to be too high. When the charge is too high, transfer becomes very nonuniform thereby exhibiting elevated levels of print mottle. Print mottle is the blotchiness that can be observed in solid areas and can be very objectionable, especially with blue toners. By decreasing the energy to the pretransfer device, the overcharging can be eliminated, but this would cause an under charged condition for the other toner resulting in reduced transfer efficiency of that toner. This problem occurs because after pretransfer the charge levels on the color and black toners are unequal and separated too far apart in tribo space. Only one or the other may fall within the tribo range that can be accommodated by a single transfer setpoint. The color toner for example has a charge level of about −26 uc/g. and the black about −16 uc/g. The 10 uc/g. delta is significant. Hence, to maximize the latitude, the charge on the black and color toners after the pretransfer treatment should be equal to one another or as close to equal as possible.

It is well known in the prior art to subject a developed image on a charge retentive surface to corona discharge prior to image transfer for various reasons. For, example, U.S. Pat. No. 3,444,369 issued on May 13, 1969 relates to a method and apparatus for the reduction of background in transferred xerographic copy. A developed toner image on a photoconductive surface is subjected to a low level corona discharge of a polarity opposite the charge on the toner particles overlying the image areas. The corona charge opposite the image areas will be repelled by the like sign, but highly charged image areas of the photoconductive surface to thereby render the image area toner unaffected. The corona charge opposite the non-image areas of the photoconductive surface will not be repelled and will thus convert the toner overlying the non-image areas to a polarity opposite that on the image area toner particles. This will permit the electrostatic transfer of the image area toner to the transfer media such as plain paper, but will tend to suppress the transfer of the non-image area toner.

It is also known to utilize light exposure and corona discharge prior to image transfer as shown in U.S. Pat. No. 4,506,971. In this device the light exposure occurs prior to the corona exposure. As stated therein, blurred images are minimized or eliminated in a xerographic reproduction prior to transfer by first exposing the image to light to at least substantially discharge the background around the image and to reduce the charge on the photoreceptor holding the image thereto. Secondly, a charge of opposite polarity of the charged photoreceptor is deposited onto the toned image and photoreceptor. This, as stated, produces a very stable image for transfer since a very strong holding force is produced to hold the image in place as the image enters the transfer station.

U.S. Pat. No. 3,784,300 issued on Jan. 8, 1974 relates to a copying apparatus with a pretransfer station including a pretranster corotron and lamp arranged such that the light exposure of the photoreceptor is subsequent and not simultaneous with the pretransfer corona charging.

U.S. Pat. No. 4,205,322 issued on May 27, 1980 relates to an electrostatic recording apparatus in which a toner image consisting of toner particles of at least two different kinds and of different polarities is efficiently and reliably transferred to a recording medium such as an ordinary sheet of paper. The toner particles having different polarities are all converted into those having one polarity and after such conversion the toner image (with its two kinds of particles) is electrostatically transferred to the recording medium, the transfer involving both kinds of particles at the same time.

U.S. Pat. No. 5,038,177 granted to Parker et al on Aug. 6, 1991 describes balanced, efficient corona transfer for both the charged area image and the discharged area image of a developed tri-level image is obtained by the provision of a selective pretransfer charge corona device in combination with a pretransfer discharge lamp. While improved transfer over prior art devices is obtained using a pretransfer lamp prior to pretransfer charging the preferred embodiment of the invention utilizes a pretransfer lamp before and in coincidence with pretransfer charging.

BRIEF SUMMARY OF THE INVENTION

Briefly, the present invention provides pre pretransfer treatment to increase the transfer operating latitude of tri-level or other multiple toner images having significant tribo differences, To this end, in one embodiment of the invention, a pre pretransfer corona treatment consisting of a single AC corona device operated in the constant dynamic current mode is used to drive the tribos of two tri-level images toward each other (in this case zero) prior to pretransfer. Subsequent pretransfer treatment serves to reduce the delta tribo between the two imaqes from 10 to 7 micro coul/g thereby providing an operating latitude of 3 micro coul/g.

In another embodiment of the invention, two pre pretransfer corona treatments are provided for driving the tribos of the two tri-level toner images toward each other (in this case zero). Two AC dicorotrons operated in the constant dynamic current mode were used for this purpose. By judiciously choosing the average dynamic current levels of both devices (in this case zero), a further reduction in the delta to 4 micro coul/g was enabled.

DETAILED DESCRIPTION OF THE PREFERRED EMBODIMENT OF THE INVENTION

Figure 4:
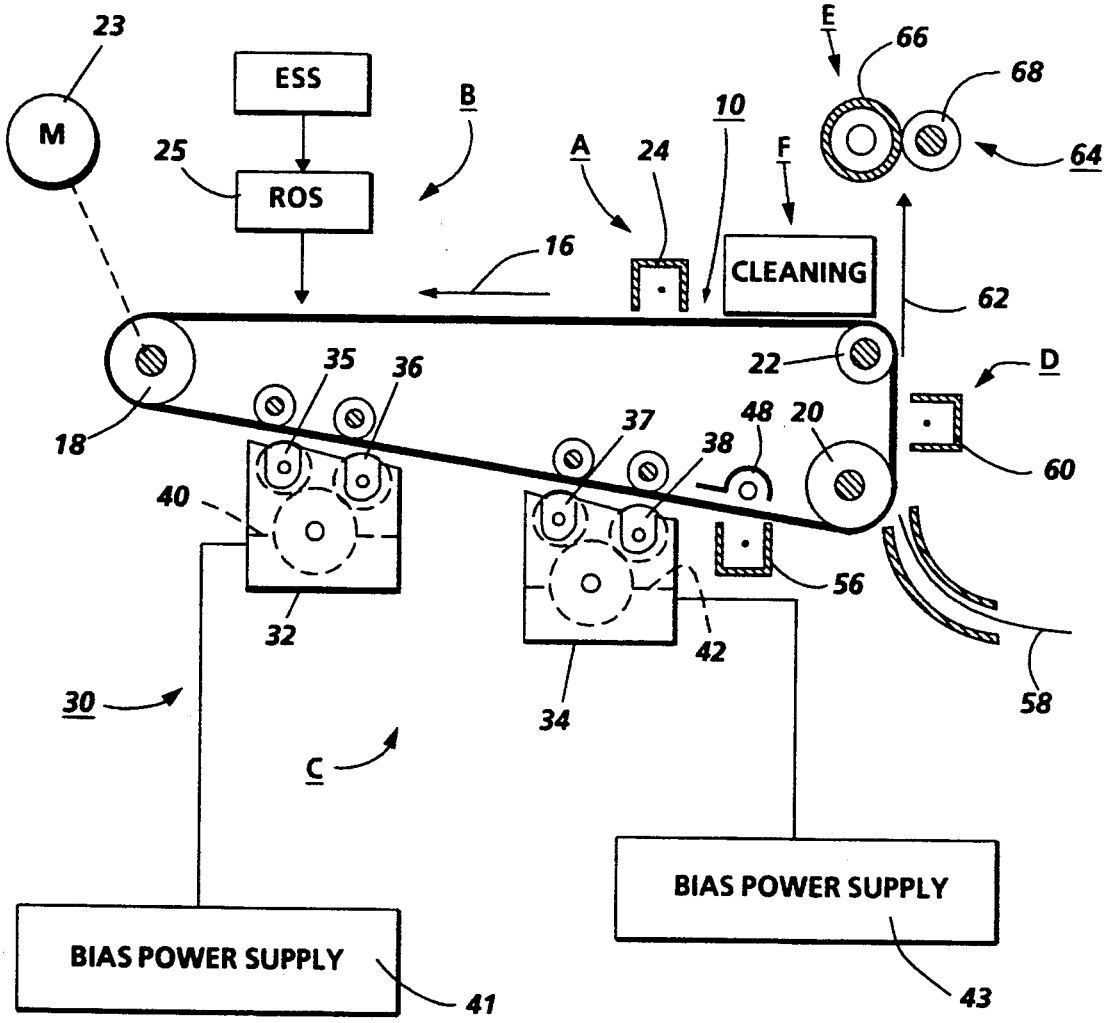
FIG. 4 PRIOR ART
FIG. 4 is a schematic illustration of a tri-level imaging apparatus incorporating the image treatments schemes illustrated in FIGS. 2*a*, 2*b*, 3*a* and 3*b*.

As shown in FIG. 4, a printing machine incorporating the invention may utilize a charge retentive member in the form of a photoconductive belt 10 consisting of a photoconductive surface and an electrically conductive, light transmissive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 4, initially successive portions of belt 10 pass through charging station A. At charging station A, a corona discharge device such as a scorotron, corotton or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images as well as charged edges corresponding to portions of the photoreceptor outside the image areas.

The photoreceptor, which is initially charged to a voltage $V_0$, undergoes dark decay to a level $V_{ddp}$ equal to about 900 volts. When exposed at the exposure station B it is discharged to $V_c$, equal to about 100 volts in the highlight (i.e. color other than black) color parts of the image. See FIG. 1*a*. The photoreceptor is also discharged to $V_w$ equal to 500 volts imagewise in the background (white) image areas. After passing through the exposure station, the photoreceptor contains charged areas and discharged areas which corresponding to two images and to charged edges outside of the image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40 by way of example contains negatively charged red toner. Electrical biasing is accomplished via power supply 41 electrically connected to developer apparatus 32. A DC bias of approximately 400 volts is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A suitable DC bias of approximately 600 volts is applied to the rollers 37 and 38 via the bias power supply 43.

Because the composite image developed on the photoreceptor consists of both positive and negative toner a negative pretransfer corona device in the form of a dicorotron 70 is provided. This type of device has been used in commercial machines. The dicorotron 70 is typically operated at a constant shield voltage of −700 volts.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E. Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figures 1A, 1B:
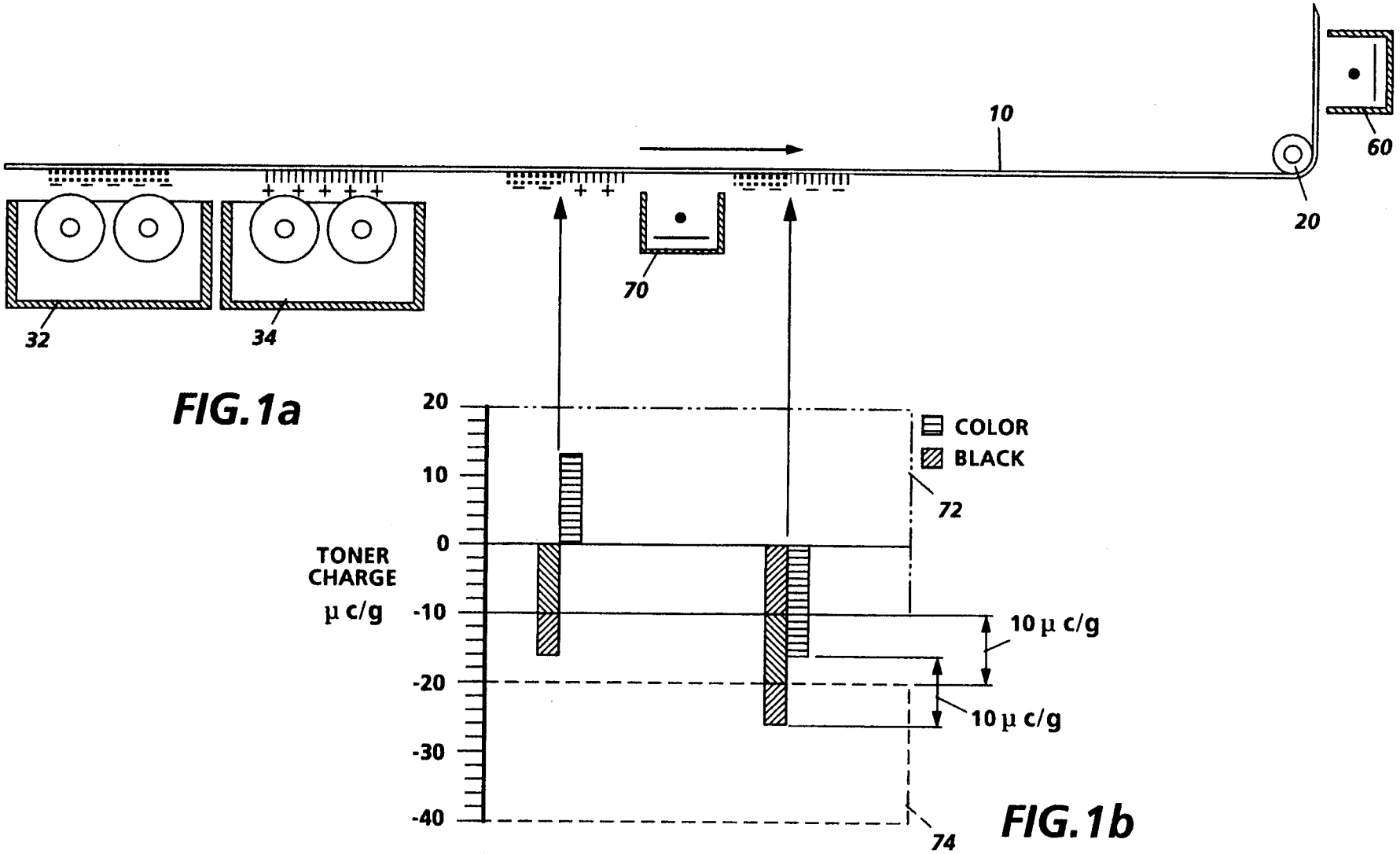
FIGS. 1*a* and 1*b* are schematic depictions of the development of a tri-level image and the effect of pretransfer treatment on the tri-level images.

As noted above, the color and black developer housings 32 and 34 (FIG. 1*a*) develop the high and low charged areas on the photoreceptor. In this case, the developed tribo (Q/M) on the developed images as indicated in a plot in FIG. 1*b* is approximately −16 micro coul/g for color and +13 micro coul/g for the black image. When the two images are subjected to the negative corona emitted by device 70 a reversal in the polarity of the black toner is effected while additional charge is added to the color image. The plot in FIG. 1*b* shows the post pretransfer Q/M values which are approximately −26 micro coul/g for the color and −16 micro coul/g for the black image. Referring to FIG. 1*b*, the shaded area 72 represents the Q/M level which is too low thereby reducing the transfer efficiency. The shaded area 74 represents a Q/M level that is too negative causing excessive transfer nonuniformity (i.e. print mottle). From the low transfer efficiency boundary (i.e. shaded area 72) to the excessive mottle (i.e. shaded area 74) boundary there is about a 10 micro coul/g operating window for the black and color toners. As indicated in FIG. 1*b*, the color Q/M is much too high and is well into the excessive mottle zone. Although reducing the pretransfer voltage level would reduce the charge on the color image, it would also reduce the Q/M on the black toner image thereby creating a poor transfer condition. The ideal situation would be to have equal Q/M on the color and black toners because the whole operating window would become pure latitude to the transfer system. However, using the prior art pretransfer treatment, results in a Q/M delta which is equal to the entire operating window of 10 micro coul/g. In reality there are a significant number of toner particles with tribos distributed around the average value. At the low end some will fall in the shaded area 72 and similarly at the high end some will have values in the shaded area 74. If the nominal average values are located at the extremes of the operating window there is a high probability that many of the toner particles will have tribo values residing outside the acceptable tribo space.

Figures 2A, 2B:
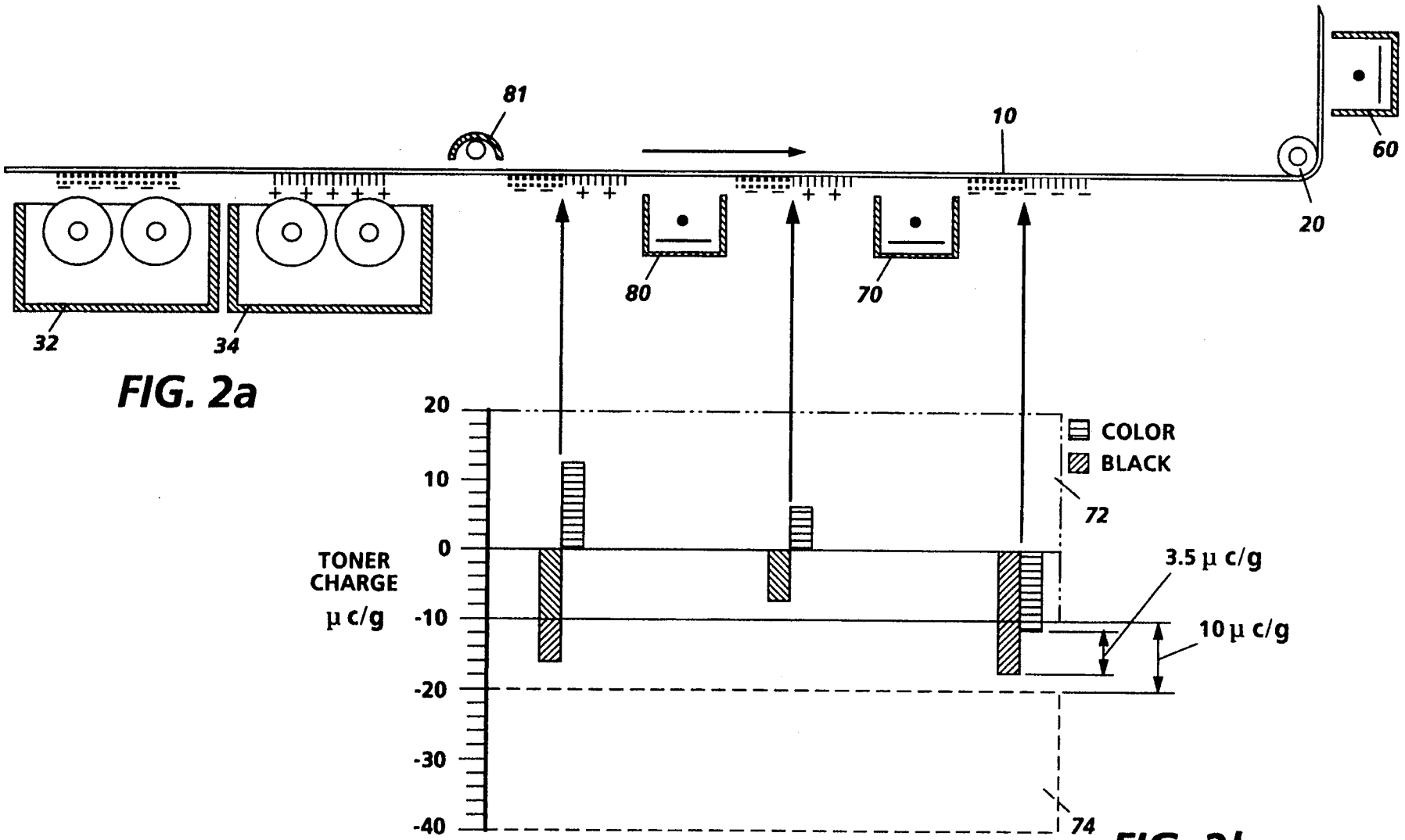
FIGS. 2*a* and 2*b* are schematic depictions of the development of a tri-level image and the effect of pre pretransfer treatment together with pretransfer treatment on the tri-level images.

The average difference of 10 micro coul/g between the tribos of the black and color images is reduced in accordance with the present invention, as illustrated in FIG. 2*b* using pre pretransfer device 80. Pre pretransfer device 80 is an AC dicorotron operated in the constant dynamic current mode which is positioned in front of the pretransfer dicorotron 70. In operation, dicorotron 80 was set at a current output level of −30 micro amps. With this arrangement, the tribos of the developed black and color images prior to the pre pretransfer treatment were −16 micro coul/g for the color image and +13 micro coul/g for the black image. As can be further seen from FIG. 2*b*, subsequent to the pre pretransfer treatment, the tribos of the two images were driven toward each other resulting in the reduction of the color tribo from −16 micro coul/g to −8 micro coul/g. Similarly, the tribo of the black image was reduced from +13 micro coul/g to +7 micro coul/g. After treatment of the images with the pretransfer dicorotron 70, set to its nominal operating setpoints (i.e. a constant shield voltage of −700 volts), the black and color image tribos were closer together, the black tribo being −11 micro coul/g while the color tribo was −18 micro coul/g. The delta between the two tribos was reduced to 7 micro coul/g which provides a 3 micro coul/g operating latitude for transfer. Prior to the pre pretransfer treatment, the images are subjected to light from a source 81 for reducing the photoreceptor to a residual value to enhance pre pretransfer image treatment.

Figures 3A, 3B:
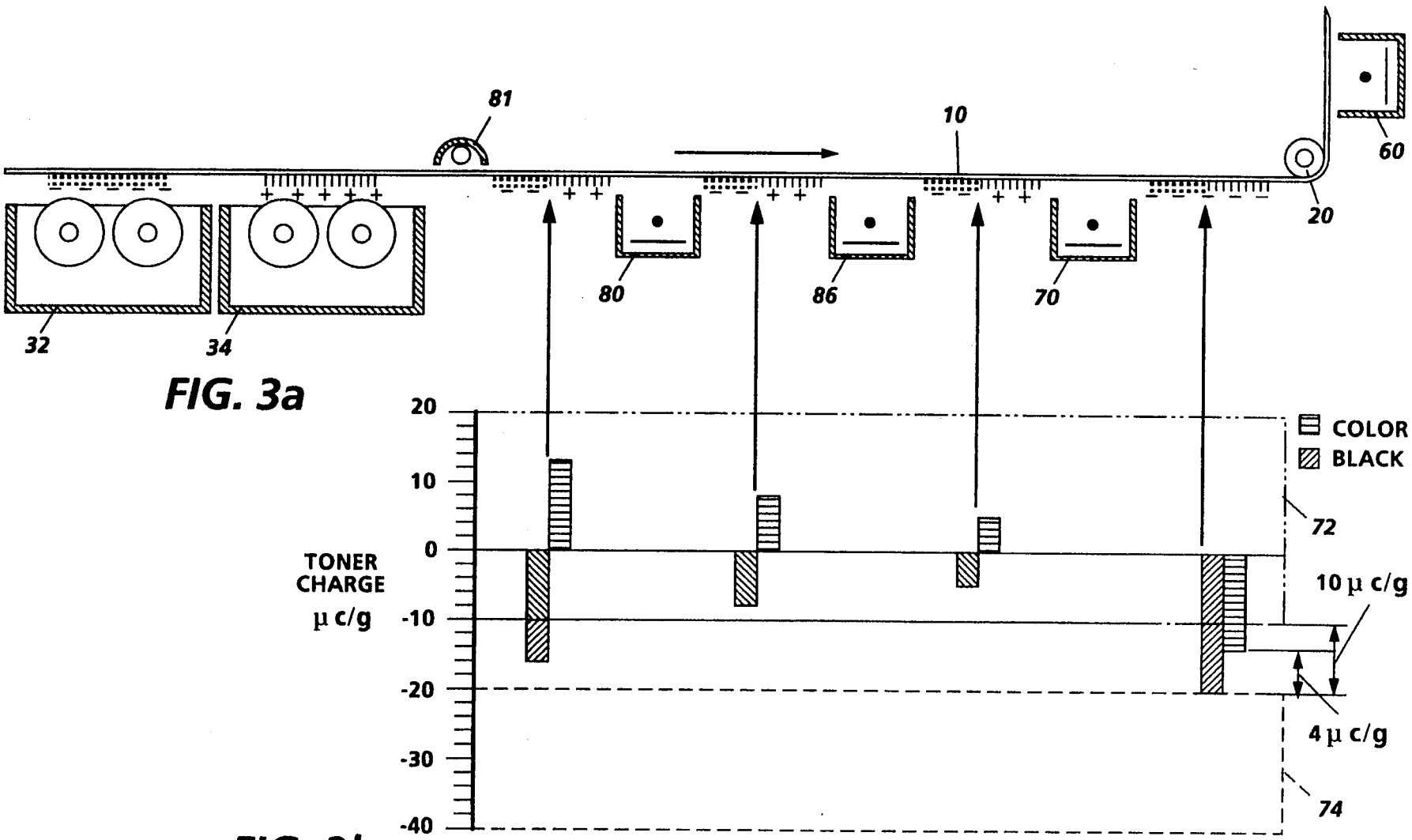
FIGS. 3*a* and 3*b* are schematic depictions of another embodiment of the invention illustrated in FIGS. 2*a* and 2*b*.

Another pre pretransfer, configuration as shown in FIG. 3*a*, utilizes two AC dicorotrons 80 and 86 operated in the constant current mode providing for two pre pretransfer treatments. The dicorotrons were both set to deliver an average zero current. A setting of zero current was chosen so that the developed images could be treated mostly by AC current. The goal was to try and drive the tri bos of both the color and black images to zero. The plot in FIG. 3*b* shows that the developed tribo prior to the first pre pretransfer treatment was +13 micro coul/g for the black image and −16 micro coul/g for the color image. After the first pre pretransfer treatment by the dicorotron 80, the tribos for the black and color images were +7 micro coul/g and −8 micro coul/g, respectively. After the second pre pretransfer treatment with the second dicorotron 86, the tribos for the black and color images were +5 micro coul/g and −5 micro coul/g, respectively. Pretransfer treatment with the dicorotron 70 resulted in black and color image tribos of −14 and −20 micro coul/g, respectively. The tribo delta in this case is 6 micro coul/g which provided a transfer operating latitude of 4 micro coul/g.

It will be understood by those skilled in the art that the pre pretransfer devices of the present invention can be modified in many different ways to achieve the desired toner charge modifications. For example, the two AC dicorotrons 80 and 86 shown in FIG. 3*a* could be replaced with a single AC device with multiple coronodes having an in process direction width comparable to or greater than the sum of the two dicorotrons and operated at comparable or greater AC currents.

In recapitulation, it is evident from the preceding description and examples that the use of pre pretransfer corona treatment in conjunction with a pretransfer corona treatment has been disclosed. This unique arrangement of corona devices is adapted for modifying toner charge to enhance transfer performance and latitude. The present invention is particularly useful for systems employing more than one toner development step, hence multiple toners that can have significantly different tribos as well as opposite polarities.

It is, therefore, apparent that there has been provided in accordance with the present invention, a pretransfer corona system that fully satisfies the aims and advantages hereinbefore set forth. While this invention has been described in conjunction with a specific embodiment thereof, it is intended that many alternatives, modifications, and variations will be apparent to those skilled in the art. Accordingly, it is intended to embrace all such alternatives, modifications and variations that fall within the spirit and broad scope of the appended claims.

We claim:

1. A method of creating multiple toner images and enhancing the transfer thereof from a charge retentive surface to a final substrate, said method including the steps of:

forming a multiple toner image on a charge retentive surface, said multiple toner image comprising a plurality of images having different charge levels;

reducing the charge level of each of said images prior to a pretransfer treatment;

subjecting said images to a pretransfer treatment;

subjecting said images to a transfer treatment and transferring said toner images to a final substrate.

2. The method according to claim 1 wherein said step of reducing the charge level of each of said toner images is effected using corona discharge.

3. The method according to claim 2 wherein step of reducing the charge level comprises using a corona device whose average DC process current can be controlled.

4. The method according to claim 3 wherein said step of reducing comprises using an AC corona device such as a dicorotron.

5. The method according to claim 4 wherein said step of reducing comprises using a plurality of AC corona device such as a dicorotrons.

6. The method according to claim 1 including a second step of reducing the charge level of said toner images, said second step of reducing also being effected prior to said step of converting.

7. The method according to claim 6 wherein said steps of reducing comprises using a pair of corona devices whose average DC process currents can be controlled.

8. The method according to claim 7 wherein said pair of corona devices are comprised of AC corona devices such as dicorotrons.

9. The method according to claim 8 wherein said constant current devices can be operated at the same or differing current levels.

10. The method according to claim 4 wherein said AC corona device comprises multiple coronodes.

11. The method according to claim 10 wherein said AC corona device is operated at an AC corona current level equal to or greater than a pair of corona devices.

12. Apparatus for creating multiple toner images and enhancing the transfer thereof from a charge retentive surface to a final substrate, said apparatus comprising:

means for forming a multiple toner toner image on a charge retentive surface, said multiple toner image comprising a plurality of images having different charge levels;

means for reducing the charge level of each of said images prior to a pretransfer treatment;

means for subjecting said images to a pretransfer treatment;

means for subjecting said images to a transfer treatment and means for effecting transfer said toner images to a final substrate.

13. Apparatus according to claim 12 wherein said means for reducing the charge level of each of said toner images comprises a corona discharge device.

14. Apparatus according to claim 13 wherein means tor reducing comprises a constant current corona device having a controllable average DC process current.

15. Apparatus according to claim 14 wherein said means for reducing comprises an AC corona device such as a dicorotron.

16. Apparatus according to claim 15 wherein said means for reducing comprises a plurality of AC corona device such as a dicorotrons.

17. Apparatus according to claim 16 including second means for reducing the charge level of said toner images, said second means for reducing being operated prior to said means for converting.

18. Apparatus according to claim 13 wherein said means for reducing comprises a pair of corona devices having a controllable average DC process current.

19. Apparatus according to claim 16 wherein said plurality of corona devices are comprised of AC corona devices such as dicorotrons.

20. Apparatus according to claim 14 wherein said constant current device can be operated at the same or differing current levels.

21. Apparatus according to claim 15 wherein said AC corona device comprises multiple coronodes.

22. Apparatus according to claim 21 wherein said AC corona device is operated at an AC corona current level equal to or greater than a pair of corona devices.

23. The method according to claim 1 wherein said step of forming multiple toner images comprises forming tri-level images.

24. The method according to claim 23 wherein said step of subjecting said images to a pretransfer treatment comprises converting the polarities of said tri-level images to the same polarity.

25. Apparatus according to claim 12 wherein said means for forming a multiple image comprises means for forming tri-level images.

26. The method according to claim 25 wherein said means for subjecting said images to a pretransfer treatment comprises converting the polarities of said tri-level images to the same polarity.

* * * * *